US011051616B2

(12) United States Patent
Spyridopoulos

(10) Patent No.: US 11,051,616 B2
(45) Date of Patent: Jul. 6, 2021

(54) CONCENTRIC CIRCULAR ROTATING TABLE(S)

(71) Applicant: Savvas Spyridopoulos, Boston, MA (US)

(72) Inventor: Savvas Spyridopoulos, Boston, MA (US)

( * ) Notice: Subject to any disclaimer, the term of this patent is extended or adjusted under 35 U.S.C. 154(b) by 0 days.

(21) Appl. No.: 16/861,424

(22) Filed: Apr. 29, 2020

(65) Prior Publication Data

US 2020/0345137 A1 Nov. 5, 2020

Related U.S. Application Data

(60) Provisional application No. 62/843,337, filed on May 3, 2019.

(51) Int. Cl.
*A47B 87/00* (2006.01)
*A47B 13/08* (2006.01)
*A47B 11/00* (2006.01)

(52) U.S. Cl.
CPC ..... *A47B 87/002* (2013.01); *A47B 11/00* (2013.01); *A47B 13/081* (2013.01); *A47B 13/088* (2013.01); *A47B 2087/004* (2013.01)

(58) Field of Classification Search
CPC . A47B 87/002; A47B 2087/004; A47B 11/00; A47B 1/056; A47B 13/081; A47B 13/088; E04B 1/3211; E04B 1/346
USPC ..... 108/66, 20, 22, 64; 52/157, 65; 297/157.1, 135
See application file for complete search history.

(56) References Cited

U.S. PATENT DOCUMENTS 55,677 A * 6/1866 Lance ..... A47B 11/00 108/94
462,933 A * 11/1891 Sanderson et al. .... A47B 13/16 108/26
1,139,564 A * 5/1915 Oberg et al. ..... A47B 1/056 108/66
1,270,212 A * 6/1918 Richeson ..... A47B 13/16 108/25
1,608,704 A * 11/1926 McConaha ..... A47B 11/00 108/20
2,447,072 A * 8/1948 Jones ..... B65G 29/00 108/22
2,644,567 A * 7/1953 Springer ..... A47F 10/06 198/570
3,437,057 A * 4/1969 Wulff ..... A47G 23/08 108/22
3,706,471 A * 12/1972 Shimosawa ..... A47C 13/005 297/158.1

(Continued)

FOREIGN PATENT DOCUMENTS

CA 3041754 A1 * 5/2017 ..... A47B 9/00
DE 19506897 A1 * 8/1996 ..... A47B 87/002
DE 202016106734 U1 * 2/2017 ..... A47B 83/001

*Primary Examiner* — Jose V Chen
(74) *Attorney, Agent, or Firm* — Joseph D. Hodler

(57) ABSTRACT

Two tables in the form of concentric circular rings provide seating positions for people on the interior of the inner ring table and the exterior of the outer ring table. People on the interior face outwards, and people on the exterior face inwards. At least one table rotates relative to the other, such that each person positioned on the interior of the inner ring table will interface with each person positioned on the exterior of the outer ring table during one full revolution of the at least one rotating table.

20 Claims, 10 Drawing Sheets

(56) References Cited

U.S. PATENT DOCUMENTS

| | | | | | |
|---|---|---|---|---|---|
| 3,953,091 | A * | 4/1976 | Shults | A47F 10/06 | 312/140.2 |
| 4,237,796 | A * | 12/1980 | Gordon | A61B 3/18 | 108/103 |
| 5,161,599 | A * | 11/1992 | Bell | B22C 11/04 | 108/139 |
| 5,950,503 | A * | 9/1999 | Amendolea | B23P 21/006 | 74/813 R |
| 6,851,748 | B1 * | 2/2005 | Garrick | A47C 7/70 | 297/240 |
| 9,380,871 | B2 * | 7/2016 | Shepherd | A47B 83/02 | |
| 9,808,082 | B1 * | 11/2017 | Nelson | A47B 11/00 | |
| 2007/0283860 | A1 * | 12/2007 | Sun | A47B 11/00 | 108/94 |
| 2011/0309659 | A1 * | 12/2011 | Beauchamp | A47C 1/12 | 297/135 |
| 2012/0304899 | A1 * | 12/2012 | Kadosh | A47B 87/0215 | 108/91 |
| 2013/0199419 | A1 * | 8/2013 | Hjelm | H02P 1/02 | 108/20 |
| 2014/0208986 | A1 * | 7/2014 | DesRoches | A47B 13/081 | 108/22 |
| 2015/0351529 | A1 * | 12/2015 | Riley | A47C 7/727 | 297/135 |

* cited by examiner

CONCENTRIC CIRCULAR ROTATING TABLE(S)

TECHNICAL FIELD

The present invention relates to dynamic furniture, and more particularly to the interaction of stationary and rotating circular tables.

BACKGROUND

Tables are commonly configured as rectangles or circles, with seating positions around the sides. Once a person selects their seating position, they generally maintain that position throughout the duration of the meeting or meal.

This arrangement of people generally remains static throughout the meeting or meal. One person may comfortably interact with a person on either side, and the people across from them.

However, the static positions of people sitting at tables inhibit collaboration with others. People sitting on the same side, but two or more chairs away are blocked by the person(s) in between. Additionally, it is impractical to communicate with people sitting far away, at larger tables.

With tables of more than four people, the inability to communicate effectively with all, or the majority, of people at the table is a problem. It necessitates a lack of synergy in groups and prevents the ability to share ideas with others not in close proximity.

A table that facilitates the ability to communicate with more people is needed. Such a table would enable social interaction, such that each person would have the opportunity to more comfortably communicate with other people, despite their initial lack of proximity at the beginning of the meeting or meal.

SUMMARY

The invention disclosed provides two concentric circular ring tables, with seating positions on the interior of the inner ring table and the exterior of the outer ring table. At least one of the ring tables rotates, affording the opportunity for each person seated on the interior to interact with each person seated on the exterior. When including the people directly adjacent on either side, this creates a situation where each person may comfortably interact with the majority of people, regardless of the group's size.

The invention is comprised of one inner ring table inside another outer ring table. The tables are concentric, and the exterior edge of the inner ring table is adjacent to the interior edge of the outer ring table.

Some people are seated around the interior edge of the inner ring table, facing outwards. At all times, a means of egress is provided to the people sitting in the interior of the inner ring table.

Other people are seated around the exterior edge of the outer ring table, facing inwards. The people on the interior and the people on the exterior are facing each other.

At least one of the two tables rotates relative to the other table, such that each position on the inner ring table will interface with each position on the outer ring table during one revolution of the rotating table. Either one or both tables is positioned upon a rotating platform. Seats associated with the rotating table will also rotate, as they are sitting on the rotating platform.

The rotation of at least one of the two tables facilitates communication between greater numbers than afforded by traditional static tables, enhancing collaboration and the ability to collectively socialize.

DETAILED DESCRIPTION

The invention disclosed provides two concentric circular ring tables, an inner ring table and an outer ring table. At least one of the tables rotates about the center axis of the ring. In the best mode, the surfaces of the tables are on the same plane, with a minimal gap between the adjacent edges. Alternative embodiments may have the inner and outer ring tables set at different heights, with the one table higher than the other.

There will be a slight gap between the inner and outer ring tables. To prevent objects from falling into this gap, a vertical flange is placed on the inside edge of the outer ring table, and on the outside edge of the inner ring table. In addition to preventing objects from falling through the gap, this flange will prevent people from placing objects across the span, where those objects would be subject to the relative motion between the two ring tables. One embodiment of the invention has a metal, aluminum, flange. Alternative embodiments may have a flat horizontal rubber ring, which extends from the edge of one ring table, slightly over the surface of the other ring table.

Rotation

Figure 1:
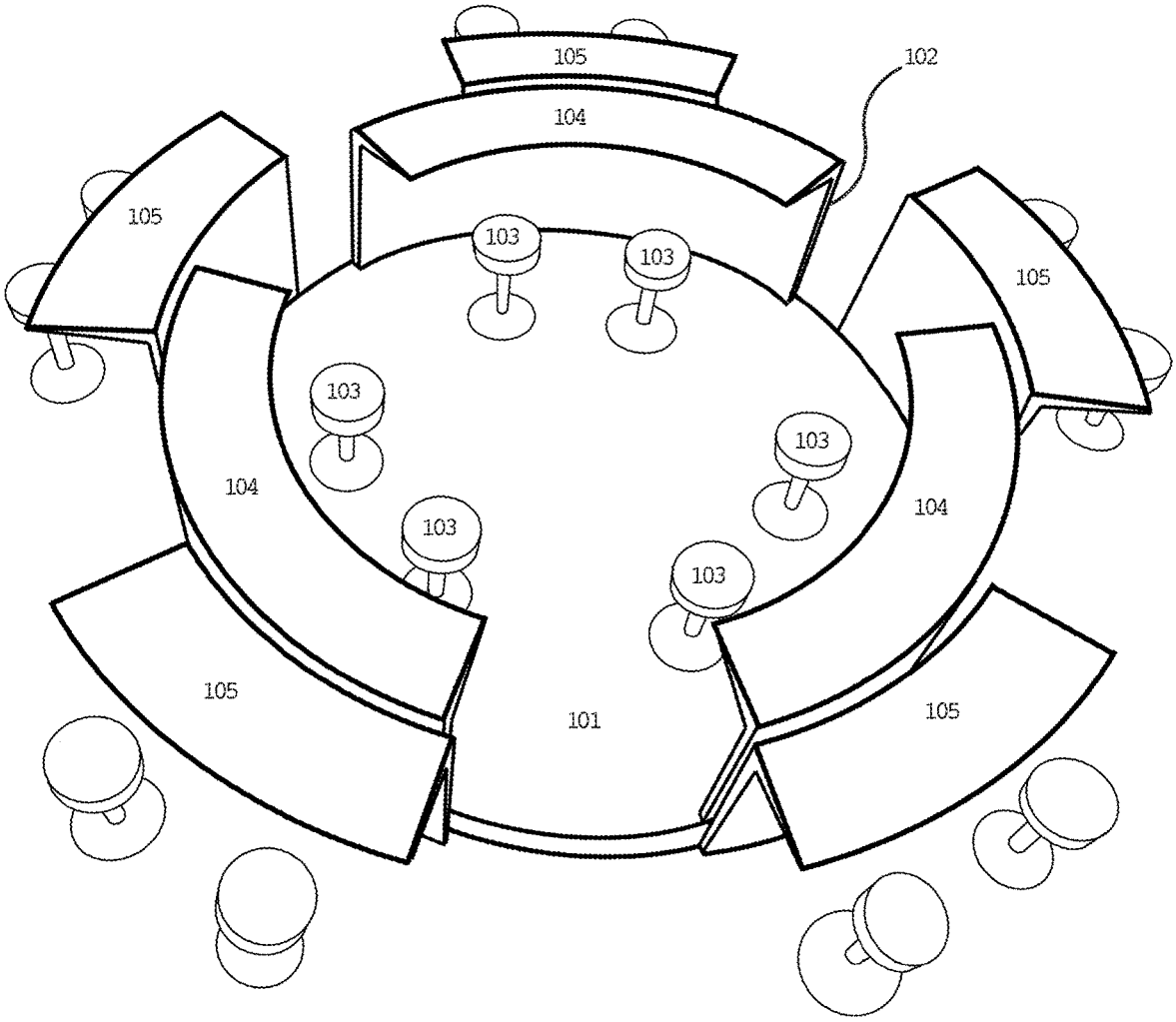
FIG. 1 is a top front perspective view of one embodiment of the invention.

At least one of the two tables is equipped with a means of rotation. FIG. 1 shows one embodiment of the invention with an inner ring table on an interior platform 101. The inner ring table may stand on the interior platform with legs. Other embodiments may have tables supported by a wall 102, pedestals, or other means.

The interior platform rotates, and therefore also rotates the inner ring table, and any seating 103 or other objects on the interior platform. In this embodiment, the interior platform may be a circle encompassing the entire area under the inner ring table and the interior of the inner ring table.

Alternative embodiments with an inner ring rotating table, may have a moving platform in the form of a ring, capable of supporting the inner ring table and the associated seating, but leaving an interior space for other purposes. This interior space might provide a means of egress, or a fixed design element.

Another embodiment has the outer table rotating on an outer platform. This embodiment would have a rotating outer platform in the form of a ring large enough to support the outer ring table and any associated seating.

Another embodiment may have two rotating platforms, an inner rotating platform and an outer ring rotating platform, such that both tables are capable of rotating.

Figure 2:
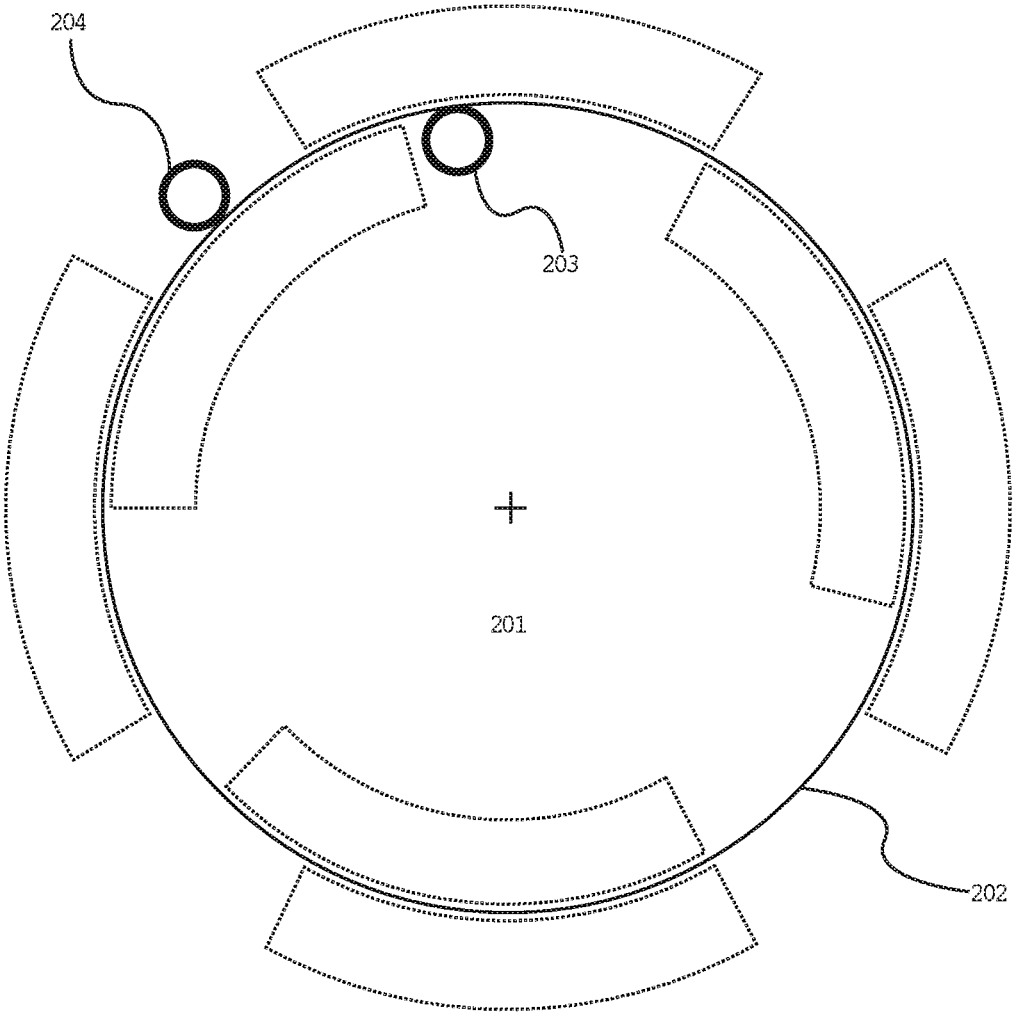
FIG. 2 is a plan view of one embodiment of the invention showing a gear system attached to the edge of a rotating platform.

There are several available means of rotation. FIG. 2 shows an embodiment of the invention where an interior rotating platform 201 has a vertical wall 202 comprising a large cog, to interact with a smaller gear placed on the inside 203 and beneath the platform or outside 204 the vertical wall. The smaller gear's axle is connected to a motor. As the smaller gear rotates, the platform rotates.

Figure 3:
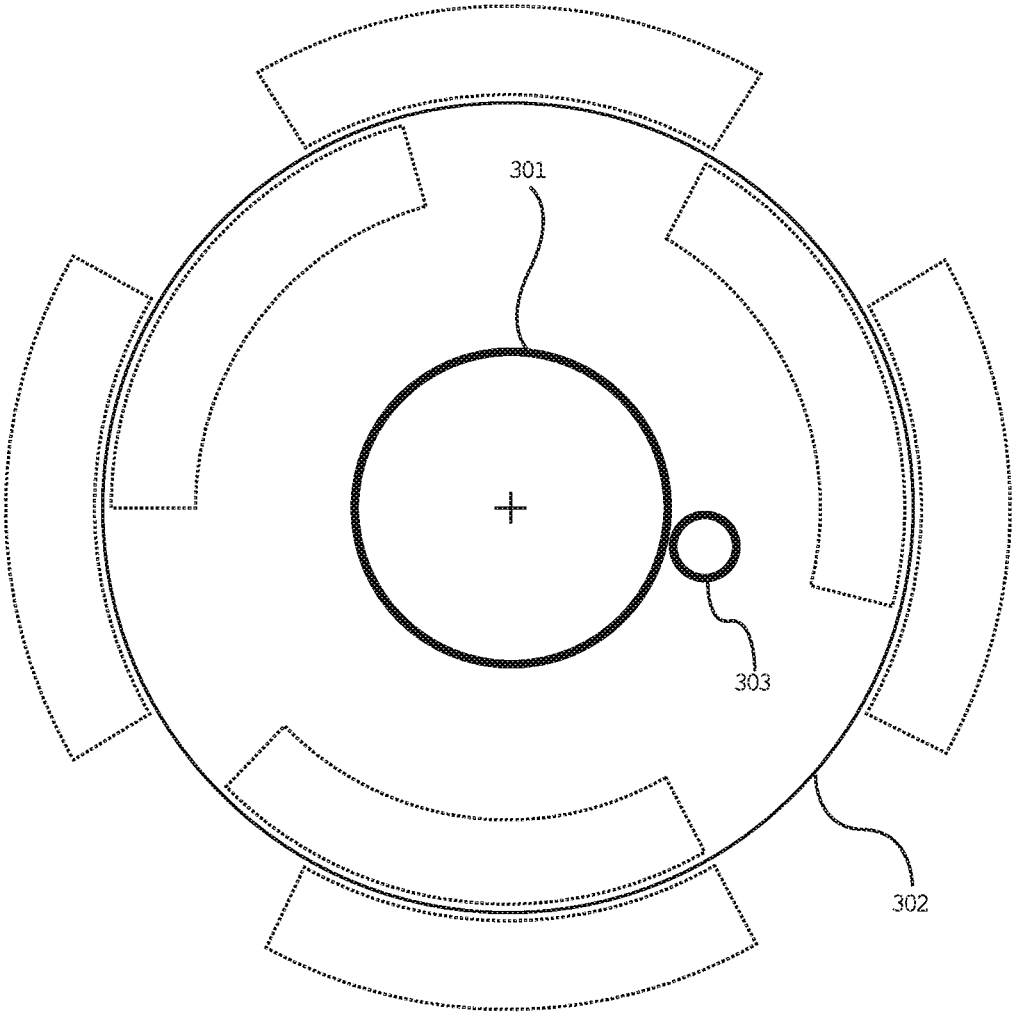
FIG. 3 is a plan view of one embodiment of the invention showing a gear system attached underneath a rotating platform.

FIG. 3 shows an alternative embodiment with a large gear 301 underneath and connected to an interior rotating platform 302. This embodiment is further comprised of a smaller gear 303 interacting with the large gear. A motor, preferably out of sight and under the platform, would rotate the smaller gear, and thus rotate the table.

Figure 4:
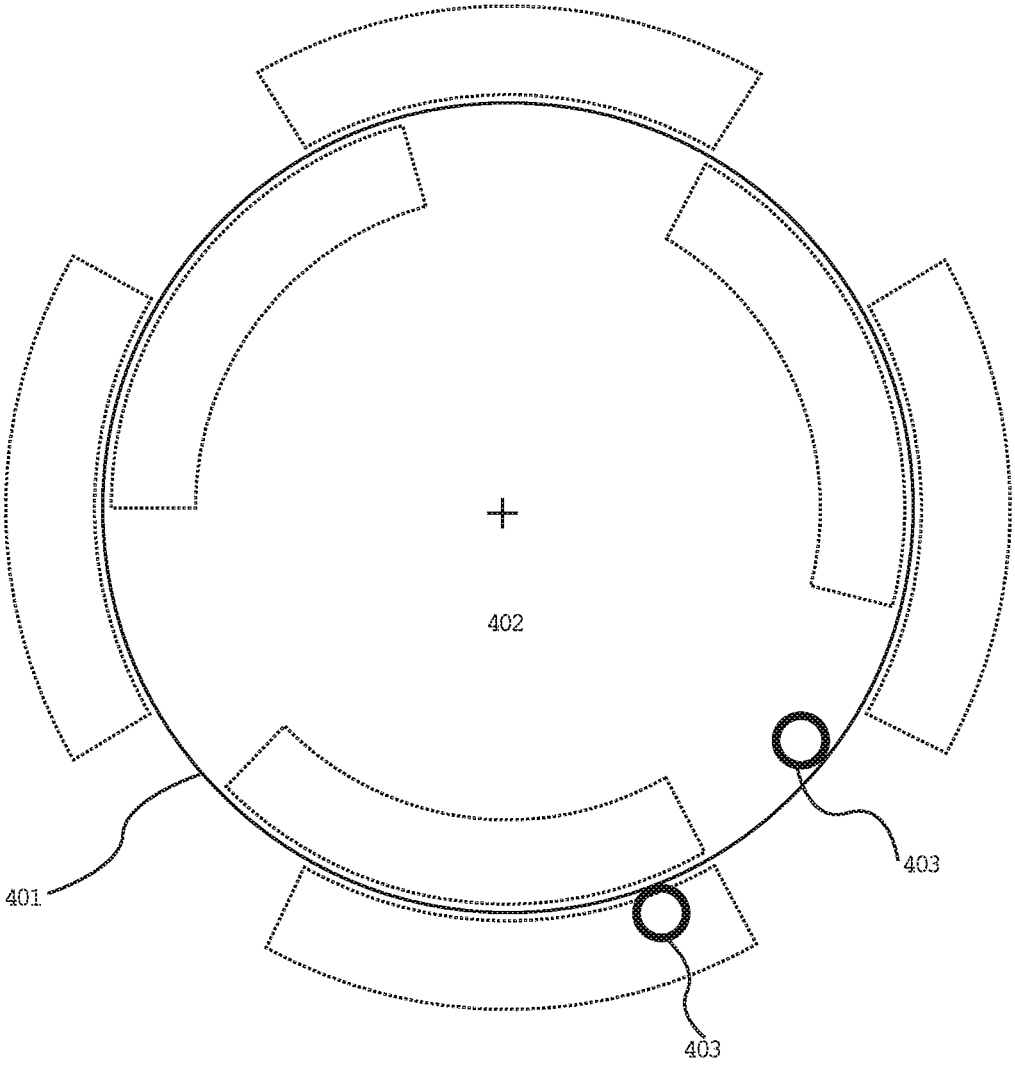
FIG. 4 is a plan view of one embodiment of the invention showing a friction wheel system attached to the edge of a rotating platform.

FIG. 4 shows an alternative embodiment driven by friction wheels. This embodiment has a vertical edge 401 descending from an interior rotating platform 402. One or more friction wheels 403 are connected to the interior or exterior of the vertical edge. The friction wheels are connected to a motor. As the friction wheels rotate, the platform rotates.

Figure 5:
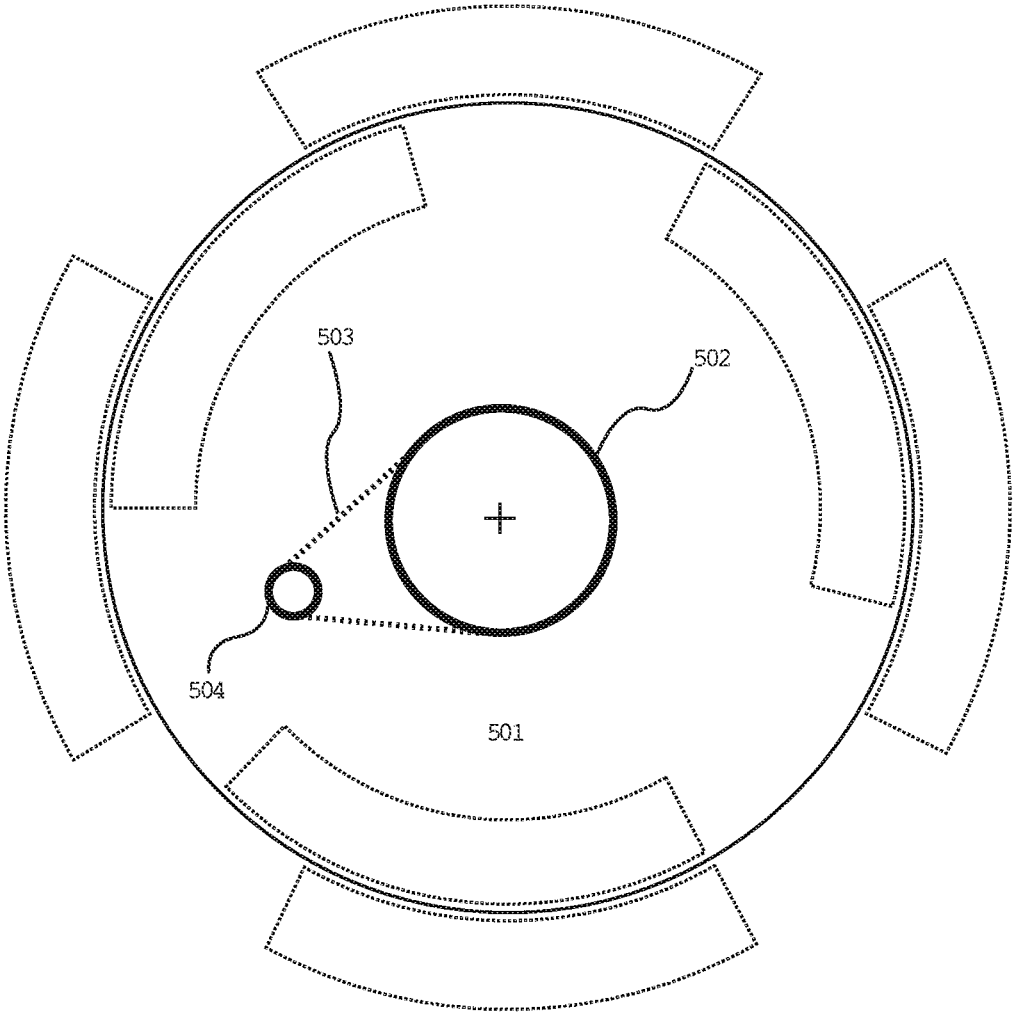
FIG. 5 is a plan view of one embodiment of the invention showing a belt or chain system attached underneath a rotating platform.

FIG. 5 shows another alternative embodiment, where an inner rotating platform 501 rotates the table with a belt driven motor connected to a central axis of the inner platform. A larger gear 502 is connected to the platform and driven by a belt 503 or chain connected to a smaller gear 504. A motor, preferably out of sight and under the platform, would rotate the smaller gear, and thus rotate the table. A person of skill in the art will appreciate the multiple alternatives for driving the rotation of one or both platforms.

The best mode of the invention has the one or two rotating platforms embedded in the floor, such that the platform heights are level with the floor height. Alternative embodiments provide a raised platform, or platforms, to afford the ability to place the invention on a solid foundation. In some embodiments, the means for rotation would be completely inside the raised platform(s).

One embodiment of the invention will provide a means for both the inner and outer tables to rotate. A user may select either the inner or outer ring table to rotate, while the other is stationary, or have both tables rotate simultaneously. The two tables may rotate simultaneously in opposite directions, or in the same direction, at the same or differing speeds.

A preferred embodiment would enable the tables to rotate both clockwise and counterclockwise. Control of rotation would permit an operator to vary the speed of rotation, as well as start and stop the rotation.

Alternative embodiments additionally consist of a control system, for manipulating and preprogramming the direction, speed, acceleration and deceleration of one or both rotating tables. For example, a user may program the inner table to slowly begin rotation at 6 p.m., at approximately one revolution per hour, and hold that rotational speed until 8 p.m. Then it may accelerate over time peaking at four revolutions per hour at 10 p.m., before slowly decelerating to a stop at 12 a.m. Variable rotation speeds and acceleration may be preprogrammed or controlled for specific situations.

Egress

FIG. 1 shows one embodiment of the invention. The inner table is divided into three arcs, with three openings. The outer table is divided into five arcs, with five openings. The inner tables 104 sit on a rotating platform 101, and the outer tables 105 are stationary. At any given time, at least one outer opening will coincide with at least one inner opening, creating a pathway for egress from the interior.

People seated in the interior of the inner table have a means of egress at all times. Other embodiments of the invention may have more or less openings, depending on size and preference.

Some embodiments of the invention may have an alternative means of egress, such as an elevator or lifting platform, placed inside the inner table, moving above or below. These embodiments would not require openings in the tables, leaving them as complete rings. Other alternative means of egress may include a ladder, spiral staircase, or standard staircase, ascending above or below the inner table. Another alternative embodiment may consist of a ramp from the center of the inner table.

Example Rotation

Figure 6:
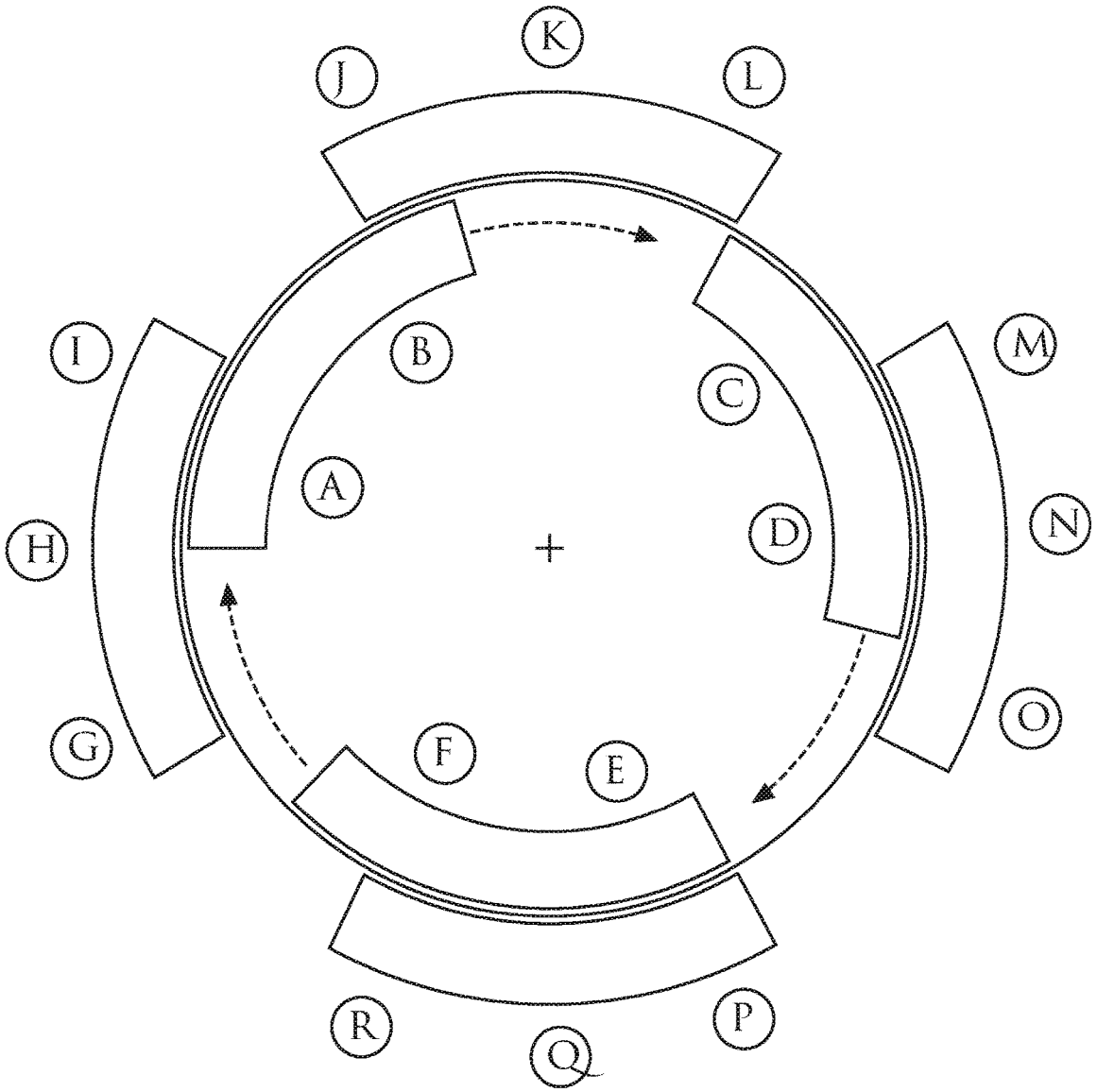
FIG. 6 is a plan view of one embodiment of the invention.

FIG. 6 shows a plan view of one embodiment of the invention, where the inner ring table is divided into three arc tables positioned on a rotating inner platform, and the outer ring table is divided into four arc tables. Each letter in FIG. 6 represents a chair position for people seated at the tables. In this figure, the person sitting in Chair A sits directly across from the person in Chair I, and likewise the person in Chair D sits directly across from the person in Chair N.

Figure 7:
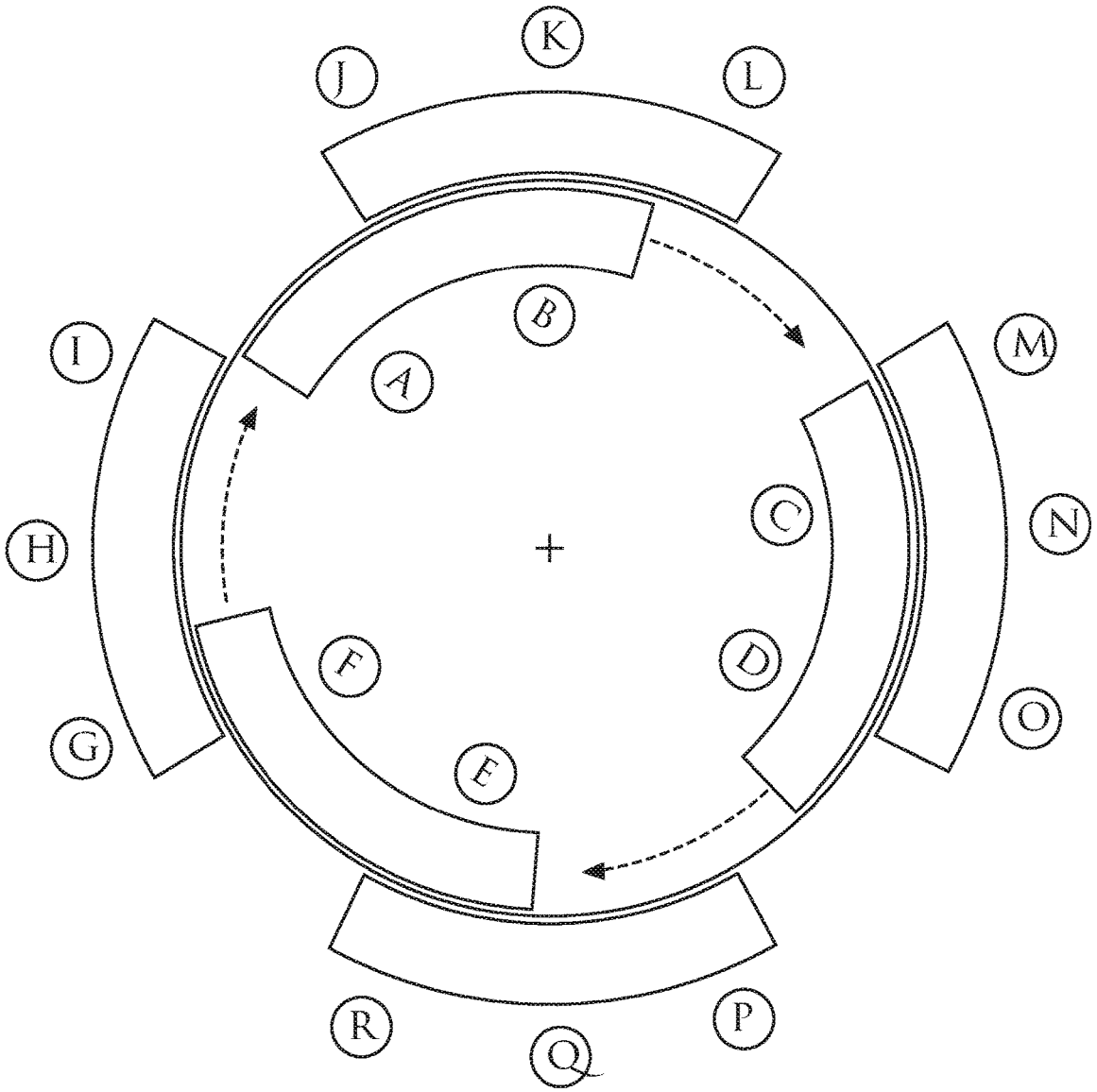
FIG. 7 is a plan view of the embodiment of the invention in FIG. 6, with the inner table rotated thirty degrees clockwise.

FIG. 7 shows the embodiment from FIG. 6, where the inner ring arc tables have rotated thirty degrees clockwise. The person in Chair A is now seated across from the person in Chair J, and the person in Chair D is now seated across from the person in Chair O.

Figure 8:
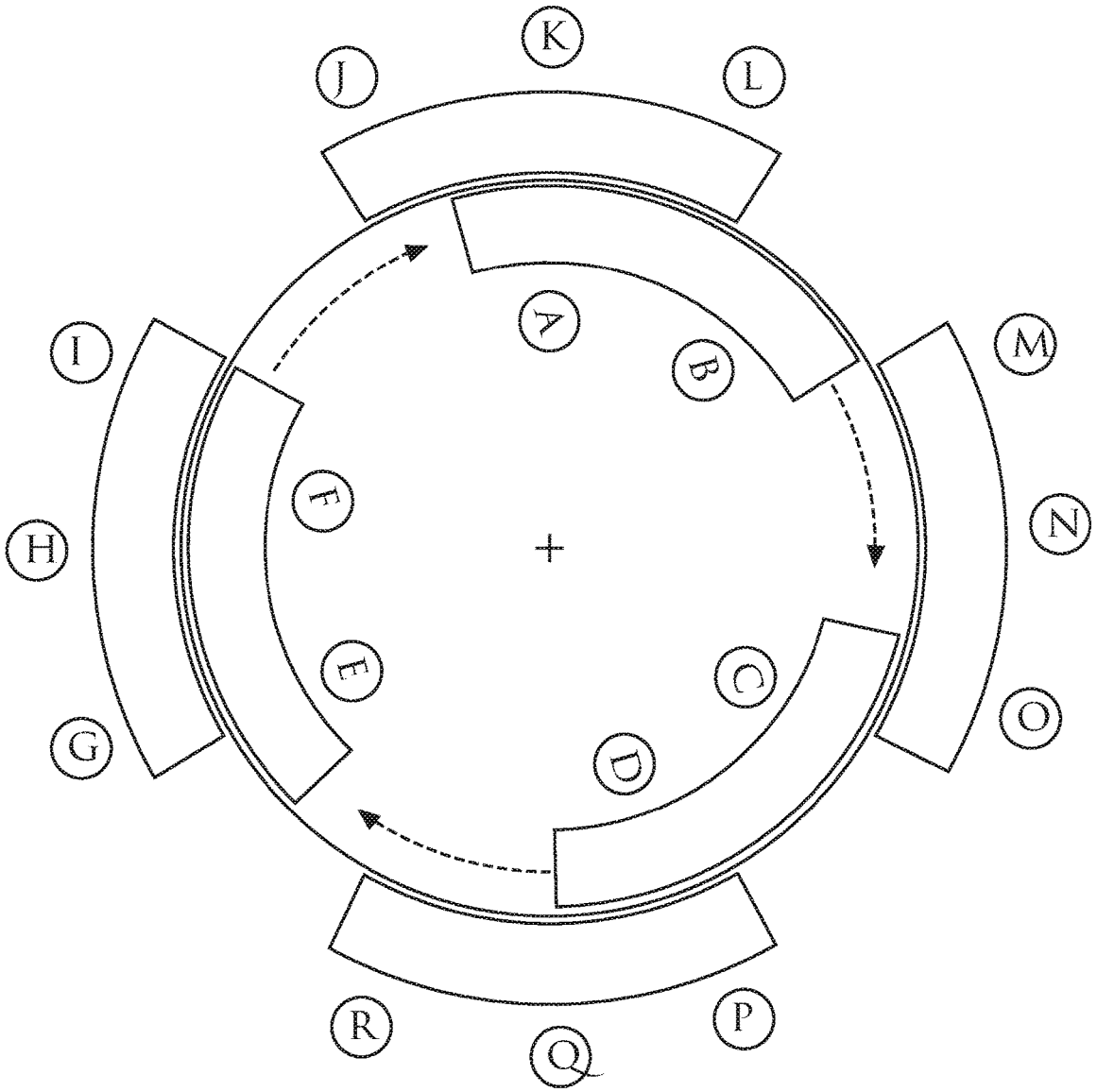
FIG. 8 is a plan view of the embodiment of the invention in FIG. 6, with the inner table rotated sixty degrees clockwise.

FIG. 8 shows the embodiment from FIG. 6, where the inner ring arc tables have rotated sixty degrees clockwise. The person in Chair A is now seated across from the person in Chair K, and the person in Chair D is now seated across from the person in Chair P.

Figure 9:
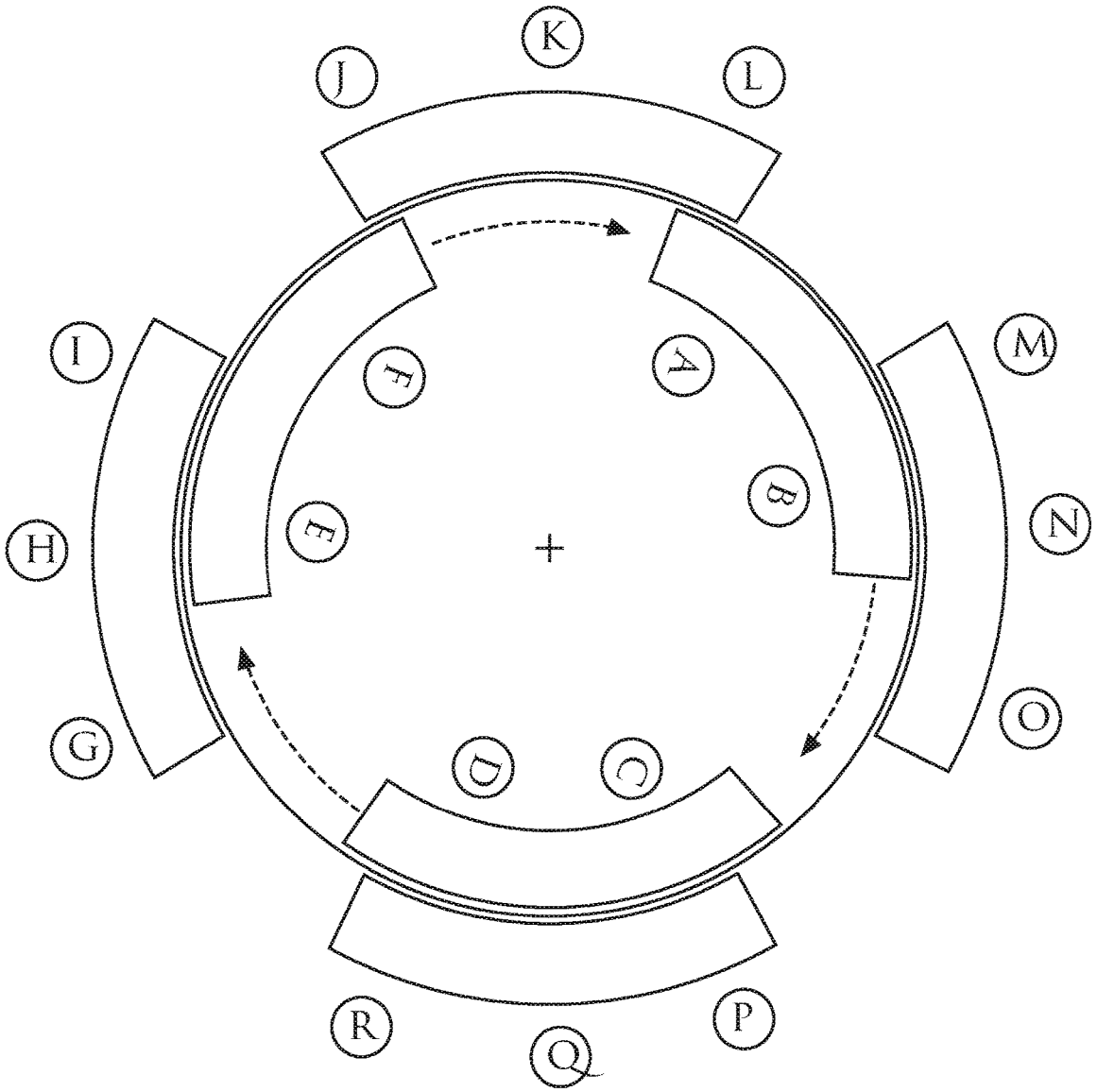
FIG. 9 is a plan view of the embodiment of the invention in FIG. 6, with the inner table rotated ninety degrees clockwise.

FIG. 9 shows the embodiment from FIG. 6, where the inner ring arc tables have rotated ninety degrees clockwise. The person in Chair A is now seated across from the person in Chair L, and the person in Chair D is now seated across from the people in Chairs Q and R.

In the embodiment represented in FIGS. 6 through 9, the inner ring arc tables rotate clockwise over time. As demonstrated, the people sitting directly across from each other vary throughout the meeting or meal, creating opportunities for people to interact with a wider range of other people, not just those sitting directly beside or across from them at the beginning of the meeting or meal.

Size and Alternative Embodiments

The inventor envisions the possibility of various table heights. Tables may be at chair height, stool height, or another height suitable for a specific need, higher or lower. In alternative embodiments, heights of the tables may vary between the inner and outer ring tables, or between the inner or outer ring arc tables. The best mode of the invention has tables at chair height. Chairs may be fixed to, or freestanding upon, a moving platform.

One embodiment of the invention has an outer ring table with an exterior edge diameter of fifteen feet. Between the interior and exterior seating positions, this embodiment would sit between fifteen and twenty people. In other embodiments of the invention, the exterior edge diameter may range from as little as eight feet, up to as much as one thousand feet. Other embodiments of the invention may seat as few as five people, or up to hundreds.

Figure 10:
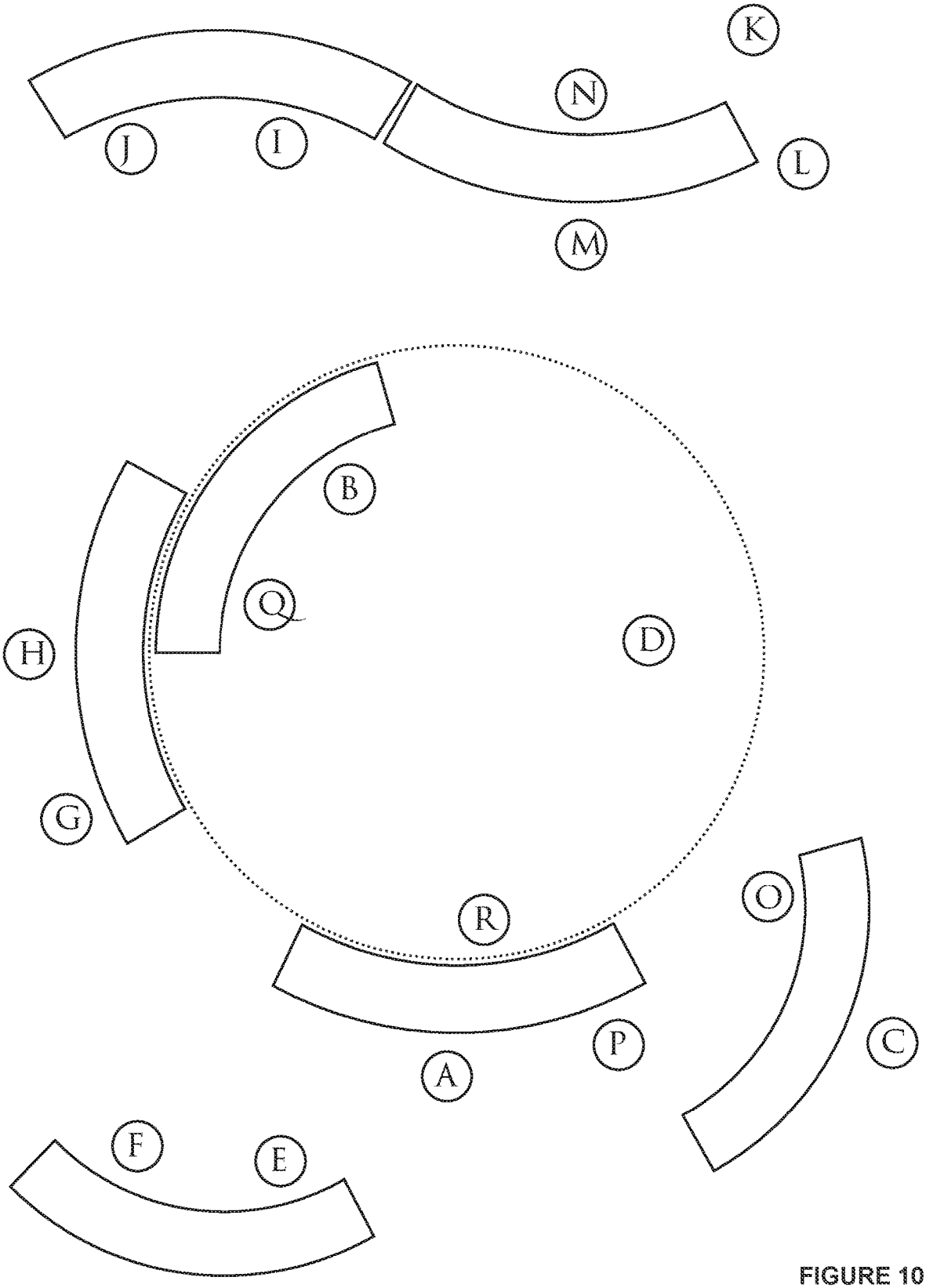
FIG. 10 is a plan view showing an embodiment of the invention with disassembled arc tables and one potential arrangement thereof.

FIG. 10 shows an alternative embodiment of the invention. The invention may disassemble, such that the individual arc tables are used as static tables, separate from the means of rotation.

An alternative embodiment of the invention has a larger gap between the two adjacent rotating edges. This gap may remain open or be filled with a third ring table. This third ring table is static and affords users the opportunity to place objects accessible to those seated at the rotating tables. Example objects may include flower arrangements, lighting, or serving platters.

An additional alternative embodiment envisions an apparatus without a moving platform. The one or two rotating tables are equipped with a means of rotation independent of the floor. In this embodiment, the seating associated with the one or two rotating tables is attached directly to the table.

Safety

Some embodiments of the invention consist of a safety feature to automatically stop rotation if an obstruction interferes with the rotation. Motion sensors similar to those in elevators or garage doors may be used to signal a need to stop rotation. Sensors may be electronic, using light or electromagnetic waves to detect motion, or tactile such as a door bumper, or mechanical safety edge.

Wheelchair Accessibility

An alternative embodiment incorporates wheelchair accessibility. One arc table of the outer ring table may be lowered to an appropriate wheelchair height. Alternative embodiments may accommodate wheelchair accessibility through other means, such as a ramp and platform for a static outer ring table.

Applications

The inventor envisions several applications for the invention. It may be useful in business, education, dining, or any social setting. Locations may include offices, schools, libraries, homes, restaurants, hotels, and casinos. The concentric circular rotating table(s) provides the opportunity for people to discuss and solve problems, make new connections, and experience a unique social interaction. Sitting at the table creates an experience where the conversations evolve as participants rotate along with the table.

The invention claimed is:

1. An apparatus for enhancing social interaction, comprising:

a. two concentric circular ring tables, an inner ring table and an outer ring table, such that the exterior edge of the inner ring table is within the interior edge of the outer ring table;

b. a means of rotating at least one ring table about an orthogonal axis through the center point of the ring tables, creating at least one rotating ring table; and c. a means of egress from the interior area of the inner ring table; wherein the at least one rotating ring table is further comprised of a vertical support and stands upon at least one rotating platform.

2. The apparatus of claim 1, wherein the inner ring table is the at least one rotating table standing upon the at least one rotating platform.

3. The apparatus of claim 2, wherein the at least one rotating platform is a circle-shaped rotating platform.

4. The apparatus of claim 2, wherein the at least one rotating platform is a ring-shaped rotating platform.

5. The apparatus of claim 4, wherein the outer ring table is the at least one rotating table standing upon the at least one rotating platform.

6. The apparatus of claim 1, wherein the inner ring table stands on a first rotating platform and the outer ring table stands on a second rotating ring-shaped platform.

7. The apparatus of claim 1, wherein the at least one rotating platform is embedded into a floor, such that the top surface of said platform is level with the surrounding floor height.

8. The apparatus of claim 1, wherein the at least one rotating platform sits on top of a flat surface.

9. The apparatus of claim 1, wherein the at least one rotating ring table rotates clockwise.

10. The apparatus of claim 1, wherein the at least one rotating ring table rotates counterclockwise.

11. The apparatus of claim 1, wherein the inner ring table rotates in one direction, and the outer ring table rotates in the opposite direction.

12. The apparatus of claim 1, wherein both ring tables rotate clockwise at different speeds.

13. The apparatus of claim 1, wherein both ring tables rotate counterclockwise at different speeds.

14. The apparatus of claim 1, wherein the means of rotating the at least one rotating platform is by one of (i) a belt driven system, (ii) a chain driven system, (iii) a gear system, or (iv) a friction wheel system.

15. The apparatus of claim 1, wherein the means of egress is provided by an arrangement of more than one opening in the inner ring table and more than one opening in the outer ring table, such that a portion of at least one opening in the inner ring table aligns with a portion of at least one opening in the outer ring table at any given time throughout the rotation of the at least one rotating ring table, permitting a person to exit from the interior of the inner ring table.

16. The apparatus of claim 15, wherein the openings in the inner ring table and the outer ring table divide the inner ring table and the outer ring table into multiple arc tables capable of being removed from the apparatus and placed statically in alternative locations apart from the means of rotating.

17. The apparatus of claim 1, further comprising a static ring table between the inner ring table and the outer ring table.

18. The apparatus of claim 1, further comprising seating directly attached to the at least one rotating ring table.

19. The apparatus of claim 1, further comprising seating positioned upon the at least one rotating platform.

20. The apparatus of claim 1, wherein the inner ring table and the outer ring table are the same height.

* * * * *